US005443880A

United States Patent [19]

Wike

[11] Patent Number: 5,443,880

[45] Date of Patent: Aug. 22, 1995

[54] POCKET-CONTAINING TOWEL OR BLANKET

[76] Inventor: Curtis J. Wike, Charlotte, N.C.

[21] Appl. No.: 929,167

[22] Filed: Aug. 11, 1992

[51] Int. Cl.[6] ..... B32B 3/14

[52] U.S. Cl. ..... 428/78; 428/85; 428/190; 2/253; D6/608

[58] Field of Search ..... 428/77, 78, 79, 85, 428/190; D6/608; 2/247, 251, 252, 253

[56] References Cited

U.S. PATENT DOCUMENTS 2,967,307 1/1961 O'Donnell ..... 2/253
3,077,604 2/1963 Colangelo ..... 2/253
4,462,116 7/1984 Sanzone et al. ..... 2/170
4,468,823 9/1984 Tounjian ..... 5/417
4,885,195 12/1989 Change, III ..... 428/36.1
5,072,467 12/1991 Hunt ..... 5/417
5,136,738 8/1992 Denson ..... 5/417
5,165,115 11/1992 Stanislaw ..... 2/247

*Primary Examiner*—Christopher W. Raimund
*Attorney, Agent, or Firm*—Ralph H. Dougherty; Scott E. Hanf

[57] ABSTRACT

An improved beach towel or blanket having compartments or pockets therein for holding articles. The pockets have integral closures, and may be lined with waterproof or water-repellent material.

11 Claims, 2 Drawing Sheets

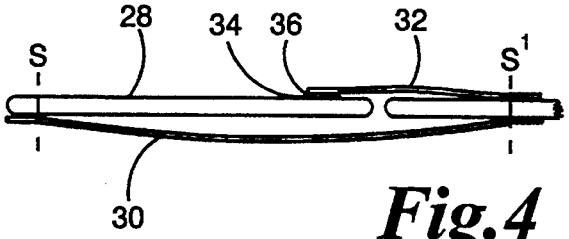
Fig.4
Fig.5
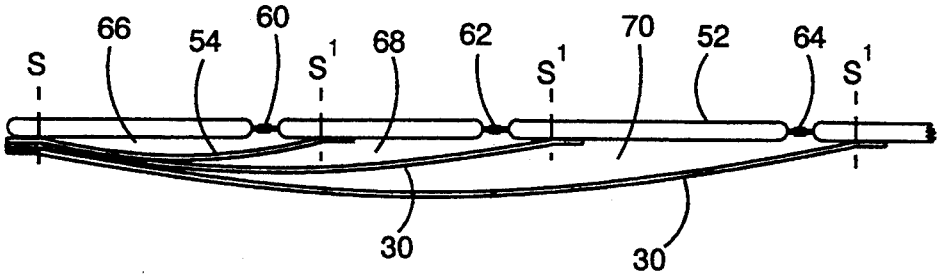
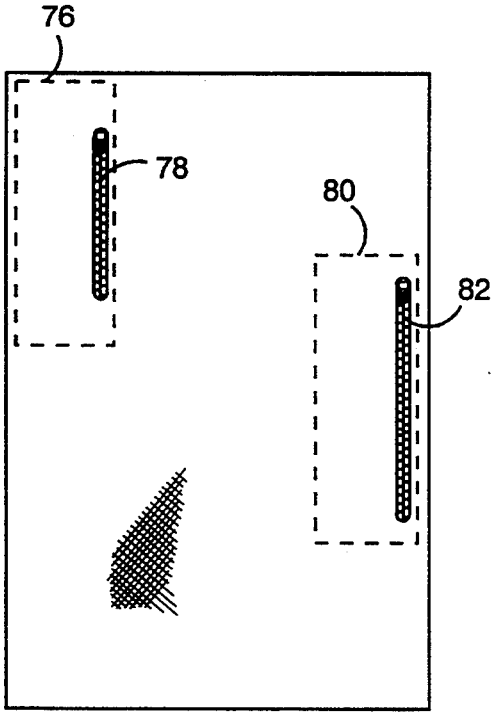
Fig.6
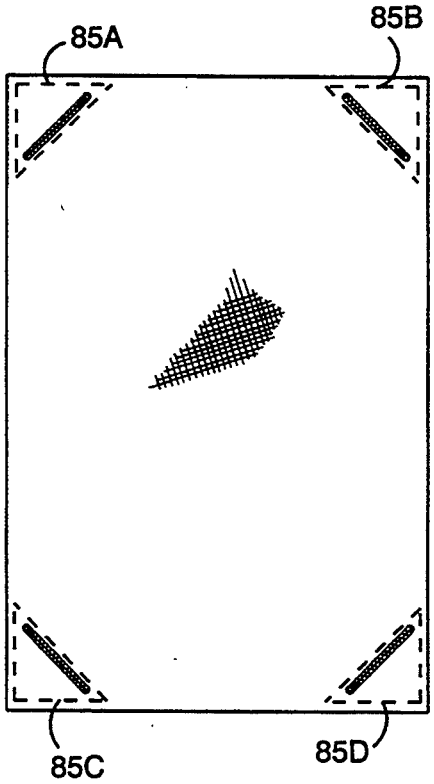
Fig.7
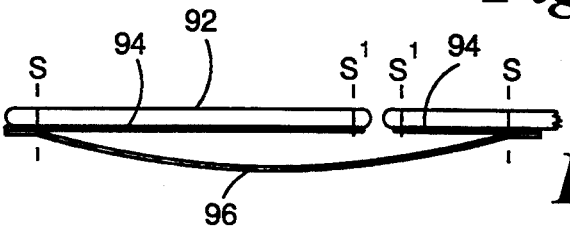
Fig.8

POCKET-CONTAINING TOWEL OR BLANKET

FIELD OF THE INVENTION

The present invention relates to towels, blankets and the like, particularly for use in recreational activities such as sunbathing, camping, etc., having one or more pockets or compartments therein.

BACKGROUND OF THE INVENTION

When sunbathing or otherwise engaging in beach-style recreation, such as at a swimming pool, a person normally takes along a large towel, known as a beach towel, or a blanket, as well as a variety of other items, such as sunglasses, money, billfold, reading material, lotion, and keys. Many of today's bathing suits have no place for holding keys or money. Further, when taking all of these items to a beach or pool situation, there is frequently an opportunity to lose them in sand, or through carelessness of others in kicking them away from the location at which they are originally placed.

The invented apparatus can be used as a type of carry-all avoiding the use of other cumbersome items to pack or carry. This is especially useful when the item is carried on a bicycle or in a boat, where storage of a more cumbersome item would be difficult.

The invented apparatus can also be made in various sizes to accommodate a number of different needs during camping or sunbathing. The apparatus is especially useful as a smaller towel for children to take to showers or baths when camping, thus eliminating the need for a cumbersome type of carry-all.

DESCRIPTION OF THE PRIOR ART

Applicant is not aware of any U.S. Patents or other related art concerning the invention.

SUMMARY OF THE INVENTION

The invention provides a compartment-containing towel article, which is preferably made from a washable material such as terry-cloth sheet material or the like. Alternatively, the compartment-containing article may be a blanket, such as an item commonly known as a "beach blanket". In either type of article, one or more compartments are formed by attaching an additional piece of textile material, preferably by sewing, but it may be attached by other means, such as gluing or even stapling. If the textile is formed of man-made fibers or plastic, the attachment may be accomplished by heat seaming.

The present invention is particularly useful for sunbathers and beach-goers, as well as campers, as it provides a convenient place to securely retain small items close at hand.

OBJECTS OF THE INVENTION

The principal object of the invention is to provide an article which can be used as a protective surface, yet has one or more convenient storage receptacles or compartments.

It is another object of the present invention to provide a beach towel or blanket article having compartment means for receiving and retaining small articles therein, at the same time being large enough to be used as a means of protection from direct exposure to sand or concrete.

It is also an object of this invention to provide a towel or blanket having compartmented means of varying sizes for holding objects of different sizes in different compartments.

It is also an object of this invention to provide a towel or blanket having a waterproof compartment therein.

It is also an object of this invention to provide a towel, sheet, or blanket with compartments that can be closed securely.

It is also an object of this invention to provide compartment closures such as a zipper, VELCRO or other type of fastener with which to protect objects stored therein from being lost or accidently dropped when the towel or blanket is either picked up or disturbed in some manner.

BRIEF DESCRIPTION OF THE DRAWINGS

The foregoing and other objects will become more readily apparent by referring to the following detailed description and the appended drawings in which:

FIG. 4 is a partial sectional view of the towel structure taken along the line 4—4 of FIG. 3.

FIG. 5 is a partial sectional view of an alternative towel structure.

FIG. 6 is a top view of an alternative towel embodiment.

FIG. 7 is a top view of another alternative towel embodiment.

FIG. 8 is a partial cross-sectional view of a towel embodiment having a waterproof compartment.

DETAILED DESCRIPTION

Figure 1:
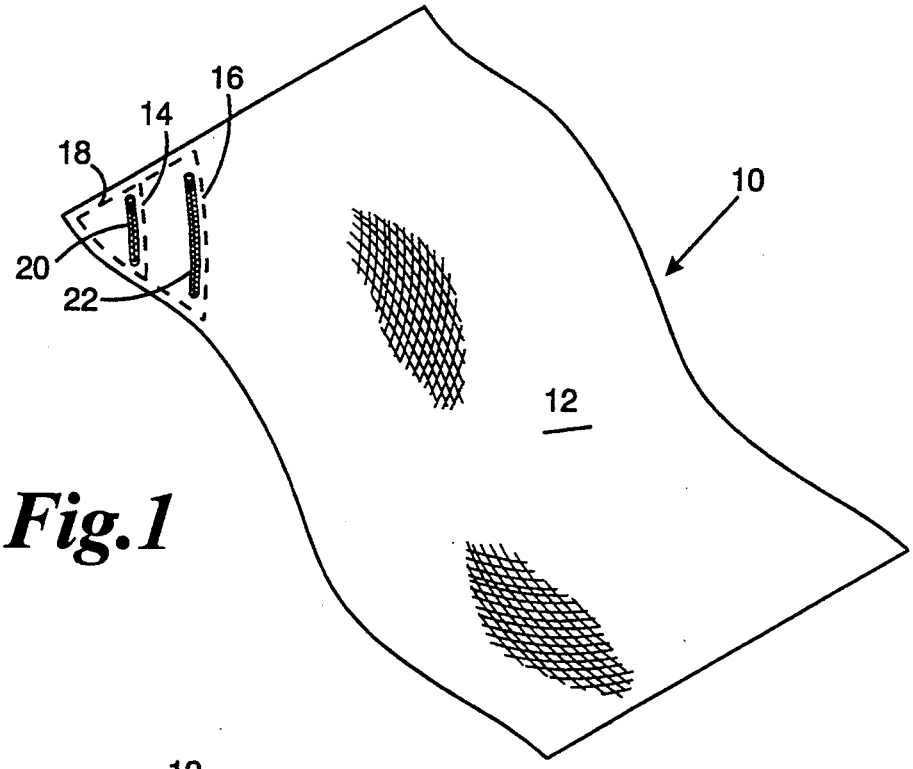
FIG. 1 is a perspective view of a beach towel or blanket containing two compartments or receptacles in accordance with the invention.
Figure 2:
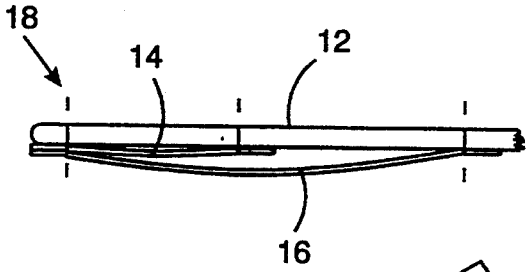
FIG. 2 is a side view of the portion of the invented towel of FIG. 1 containing the compartments, but on a larger scale.

Referring now to the drawings, and particularly to FIG. 1, the invented towel article 10 includes a sheet 12, preferably of terry-cloth material, of any desired length and width. In one corner a pair of compartments or pockets are formed by sewing, or otherwise attaching, two pieces of material, a small triangular piece 14, and a larger triangular piece 16. These two textile pieces 14 and 16 are also sewn along the seam line or stitch line 18. A pair of article-receiving chambers, or pockets, are thus formed between the textile material 12 and 14, and between the textile material 16 and its mating surfaces of material 14 and 12. Access to the compartments is provided in the embodiment of FIG. 1 by zippers 20 and 22, respectively.

Figure 3:
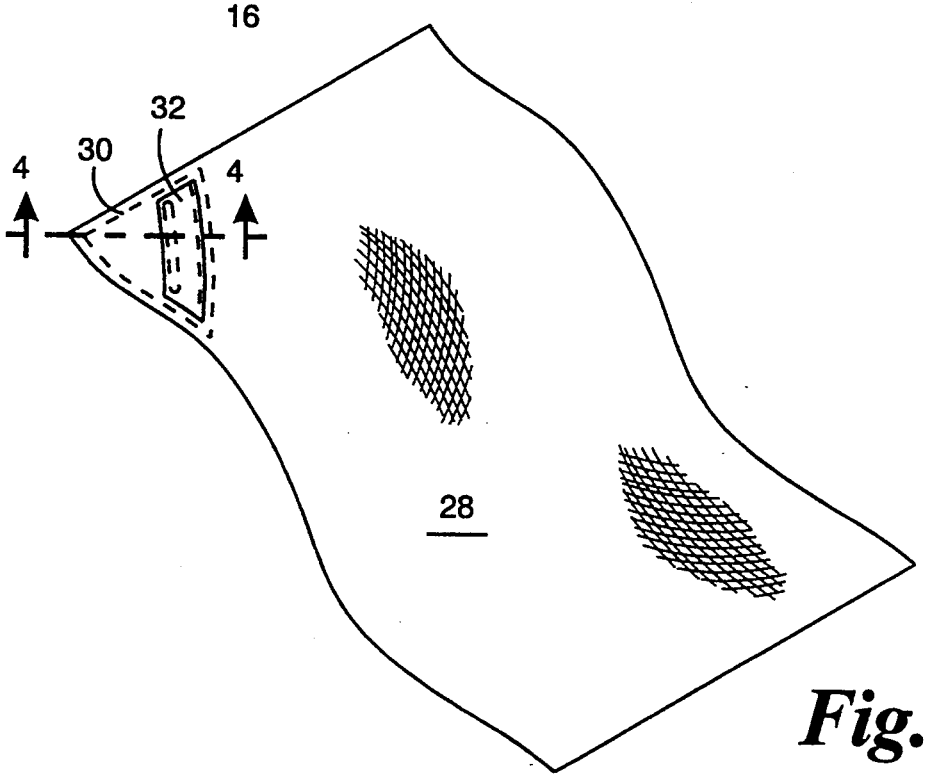
FIG. 3 is a perspective view of an alternative compartmented beach towel structure.

As shown in FIG. 3, a triangular pocket has an access flap 32, the underside of which has a VELCRO strip affixed thereto for mating with an opposing VELCRO strip 36 on textile sheet 28, as shown in FIG. 4. Stitch lines in FIG. 4 are indicated as lines S, S'.

FIG. 5 shows how three compartments can be incorporated into the towel device. Sheet 52 has affixed to it three smaller pieces of textile material 54, 56, which is larger than 54, and 58, which is larger than 56. The stitch lines S are indicated showing how many sheets are connected at each stitch location. Zippers 62 and 64 are provided for access to each of the three pockets 66, 68, and 70, respectively. If desired, one or more of the intermediate pieces of material 54, 56, may be a water-repellant or waterproof material.

FIG. 6 shows two alternative pocket types and locations, pouch 76 is located near one end, and is specifically adapted for laying across a chair such as a lounge chair, so that the zipper 78 will be located on the higher side of the pouch when hanging from the lounge chair. Pouch 80 is more centrally located near the side with the zipper at the edge.

The embodiment of FIG. 7 shows four corner pouches each of which can be used to contain items which will weight the four corners to inhibit the blowing of the towel or blanket while on the beach. Advantageously, these four corner pouches can each be sufficiently large to accommodate a shoe.

FIG. 8 shows a single pocket with the underside of sheet material 92 having a waterproof, or water-resistant lining 94. The material 96 can also be either a water-repellant lined material or a water-repellant or waterproof material, such as tightly-woven cloth, plastic, vinyl, oil-cloth, rubberized material, or the like.

Advantageously, the zippers and pouches or compartments are located at one or more corners of the beach towel or blanket device at an angle from the edge of from 30°–60°, preferably, about 45°. As shown in FIGS. 6 and 7, compartments of different sizes and shapes can be provided at various locations, as desired.

ALTERNATIVE EMBODIMENTS

A compartment-containing towel can be produced where the first and second pieces of textile material have substantially the same dimensions, in which case one or comprising multiple compartments can be formed between the first and second pieces of textile material, each compartment being defined by outline stitching thereof, and being provided with an access slot and a closure, such as a zipper or VELCRO fastener.

Although the zippers are shown as being provided in the larger sheet piece of towel or blanket material, the zippers could just as readily be provided in the smaller piece on the underside of the larger sheet, which may then be turned over to become the upper side.

SUMMARY OF THE ACHIEVEMENT OF THE OBJECTS OF THE INVENTION

From the foregoing, it is readily apparent that I have invented an improved beach towel or blanket article having integral compartment or receptacle means for receiving and retaining small articles therein, while at the same time being large enough to be used as a means of protection from direct exposure to sand or concrete, such compartments may be of varying sizes for holding objects of different sizes in different compartments, or may be waterproof, as well as being provided with secure closures.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A towel having an integral compartment therein, comprising:

a first piece of textile material defining the maximum dimensions of the towel;

a second piece of textile material fixed to said first piece of material creating a first compartment between the two pieces of material;

access means through said first piece of material to the interior of said first compartment;

a third piece of textile material fixed to said first piece of material, extending over said second piece on the side away from said first piece creating a second embodiment between said second and third pieces of material; and access means through said first piece of material to the interior of said second compartment.

2. An article according to claim 1 wherein said first piece of textile material is terry-cloth, and said second and third pieces of textile material are a water-repellent material.

3. An article according to claim 1 wherein said first piece of textile material has a water-repellent lining thereon, on the side adjacent said second piece of textile material.

4. An article according to claim 3 wherein said lining is a fourth piece of textile material.

5. An article according to claim 1 wherein said compartment is triangular.

6. An article according to claim 1 further comprising closure means integral with said access means, each such closure means being parallel to each other closure means.

7. A rectangular towel having an integral compartment therein, comprising:

a piece of textile sheet material defining the maximum dimensions of the towel, and having an upper side and an underside:

a first piece of water-repellant textile material fixed to the underside of said piece of textile sheet material as a moisture barrier;

a second piece of water-repellant textile material fixed to the underside of said first; piece of water-repellant textile material, and extending over said second piece on the side away from said first piece generally coextensive with said first piece of water-repellant material, and creating a compartment between said first and second pieces of water-repellant textile material on the underside of said textile sheet; and access means through said piece of textile sheet material and said first piece of water-repellant material to the interior of said compartment.

8. An article according to claim 7 further comprising closure means integral with said access means, each such closure means being parallel to each other closure means.

9. An article according to claim 7 wherein said compartment is rectangular.

10. A rectangular textile sheet article having an integral compartment therein at each corner thereof, comprising:

a piece of textile sheet material defining the maximum dimensions of the textile sheet, and having an upper side and an underside;

a first triangular piece of water-repellant textile material fixed to each corner of the underside of said piece of textile sheet material as a moisture barrier;

a second triangular piece of water-repellant textile material fixed to each corner of the underside of said first piece of material, generally coextensive with said first triangular piece of water-repellant material, and creating a compartment between the two triangular pieces of material at each corner of said textile sheet; and access means through said piece of textile sheet material and each first triangular piece of water-repellant material to the interior of each of said corner compartments.

11. An article according to claim 10 further comprising closure means integral with said access means, each such closure means being a zipper.

* * * * *